United States Patent [19]

Wolf et al.

[11] 4,066,396

[45] Jan. 3, 1978

[54] DYEING DRY-SPUN AROMATIC POLYAMIDES

[75] Inventors: Gerhard Dieter Wolf; Ralf Miessen; Hans Egon Künzel, all of Dormagen; Francis Bentz, Cologne, all of Germany

[73] Assignee: Bayer Aktiengesellschaft, Leverkusen, Germany

[21] Appl. No.: 602,784

[22] Filed: Aug. 7, 1975

[30] Foreign Application Priority Data

Aug. 10, 1974 Germany ..... 2438546

[51] Int. Cl.[2] ..... D06P 3/24

[52] U.S. Cl. ..... 8/178 A; 8/41 B; 8/42 B; 8/85 B; 8/86; 8/162 S; 8/171; 8/172 R; 8/172 A

[58] Field of Search ..... 8/178 A, 172, 172 R, 8/172 A, 171, 85 B, 86; 28/75

[56] References Cited

U.S. PATENT DOCUMENTS

| | | | |
|---|---|---|---|
| 2,558,733 | 7/1951 | Cresswell et al. | 264/182 |
| 2,558,735 | 7/1951 | Cresswell | 18/47.5 |
| 3,111,357 | 11/1963 | Wirth et al. | 8/55 |
| 3,184,436 | 5/1965 | Magat | 260/78 |
| 3,233,019 | 2/1966 | Adams | 264/78 |
| 3,376,268 | 4/1968 | Preston | 260/78 |
| 3,380,969 | 4/1968 | Hill et al. | 260/78 |
| 3,434,189 | 3/1969 | Buck et al. | 28/75 |
| 3,483,576 | 12/1969 | Nakagawa et al. | 8/177 |
| 3,543,359 | 12/1970 | Whitaker | 28/72.16 |
| 3,558,267 | 1/1971 | Langenfeld | 8/172 |
| 3,602,966 | 9/1971 | Fleissner | 28/1.2 |
| 3,888,821 | 6/1975 | Milford | 260/45.8 |

*Primary Examiner*—A. Lionel Clingman
*Attorney, Agent, or Firm*—Plumley and Tyner

[57] ABSTRACT

The invention relates to a process for the production of dyed filaments of aromatic polyamides which have not been modified with acid or basic group.

11 Claims, No Drawings

DYEING DRY-SPUN AROMATIC POLYAMIDES

This invention relates to a process for dyeing fully aromatic polyamides optionally containing heterocyclic groups with cationic or anionic water-soluble dyes. The process according to the invention essentially comprises dry-spinning solutions of fully aromatic polyamides optionally containing heterocyclic groups by conventional methods and passing the filaments obtained before or during stretching through an aqueous bath containing a cationic or anionic dye.

The dyeing of wet-spun polyacrylonitrile polymers in "gel form" with water-soluble cationic dyes in an aqueous dye bath has been repeatedly described in (U.S. Pat. No. 3,113,827; U.K. Patent Specification No. 991,957; U.S. Pat. No. 3,111,357; German Offenlegungsschrift No. 1,494,628; U.S. Pat No. 3,242,243). In order to guarantee a sufficiently deep and washproof dye finish, the acrylonitrile polymers or copolymers are modified with acidic groups, preferably sulphonate groups.

However, it is known among experts that the dyeing of fully aromatic polyamides optionally containing heterocyclic groups has hitherto proved difficult and expensive, even in cases where the polyamides have contained acidic groups in order to improve their dyeability. According to one conventional recipe for dyeing aromatic polyamides, for example poly-m-phenylene isophthalamide, with cationic dyes, the following procedure is adopted:

"The following additions are made to a bath heated to 30° C, which is kept in constant circulation:

- 40 g/l of benzaldehyde emulsion (the benzaldehyde emulsion is made up of 98 parts of benzaldehyde and 2 parts of non-ionic emulsifier),
- 20% of sodium chloride (= 20 g/l of sodium chloride for a dye solution ratio of more than 1:20),
- 0.5% of a standard commercial-grade non-ionic surface-active dispersant,
- pH 4–4.5 buffered with trisodium phosphate or tetra sodium pyrophosphate.

The dissolved dye is then added and the temperature of the solution increased over a period of 45 to 60 minutes to the final dyeing temperature required to 120 to 130° C (pressure vessel). Dyeing takes 1 to 2 hours. The dyeing process is completed by gradual cooling and rinsing.

In order to remove the benzaldehyde from the fibres, the dye finishes obtained have to be subjected to after-treatment under reducing conditions. To this end, the material is treated in a solution containing.

- 2 g/l of conc. hydrosulphite,
- 0.5 g/l of a standard commercial-grade non-ionic surface-active dispersant
- and trisodium phosphate or tetrasodium pyrophosphate for adjusting a pH-value of from 7 to 8.

The temperature of the treatment bath is 90° – 95° C and the treatment time 10 minutes.

The treatment should be repeated after rinsing.

This proven "high-temperature process" for dyeing aromatic polyamides is extremely complicated, time-consuming and expensive.

Accordingly, it was extremely surprising to find that dry-spun filaments of aromatic polyamides optionally containing heterocycles can be given deep, washproof dye finishes in a simple, continuous process. It is particularly surprising that the aromatic polyamides or the aromatic polyamides containing heterocycles do not have to contain any acid groups. It is also particularly remarkable that the quantity of dye taken up by the filaments in the dyeing process according to the invention can be greater than it is in the "high-temperature dyeing process" described above.

It is an object of this invention to provide a simple and continuous process for the production of dyed filaments of aromatic polyamides. Other objects will be evident from the description and the Examples. These objects are accomplished by a process for the production of dyed filaments of aromatic polyamides optionally containing heterocyclic groups which polyamide has not been modified with acid or basic groups, wherein dry-spun filaments of said aromatic polyamides are dyed before or during stretching in an aqueous bath containing a cationic or anionic water-soluble dye.

Fully aromatic or aromatic polyamides or copolyamides containing heterocycles which may be dyed with advantage by the process according to the invention are described, for example, in the following patent specification: U.S. Pat. Nos. 2,979,495; 3,006,899; 3,354,127; 3,380,969; 3,349,061; patent specification No. 6,809,916; U.K. Patent Specification No. 718,033; German Offenlegungsschrift Nos. 1,811,411; and 1,946,789.

Most of these aromatic polyamides or copolyamides optionally containing heterocycles are soluble in polar organic solvents, such as N,N-dimethyl formamide, N,N-dimethyl acetamide or N-methyl pyrrolidone, at least in cases where a few percent of an alkali or alkaline earth metal salt, such as calcium chloride or lithium chloride, are added as solution promoter, and may readily be spun by the dry-spinning process known per se.

Cationic and anionic dyes may be used with particular advantage as the water-soluble dyes. A few dyes are identified by way of example in the following:

(A)

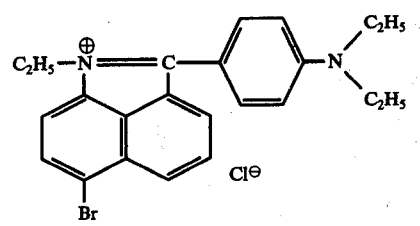

(B)

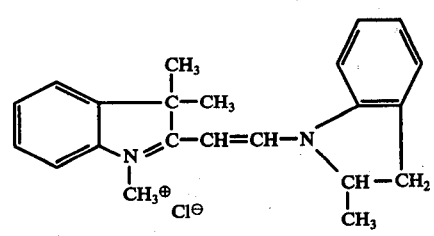

(C)

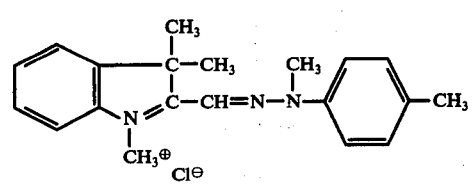

-continued
(D)
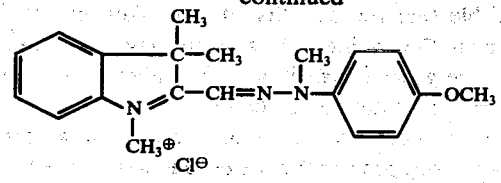
(E)
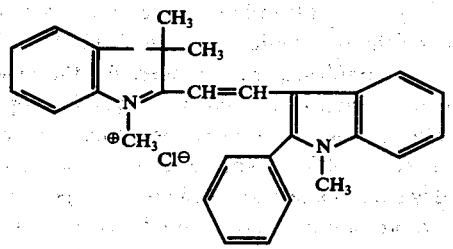
(F)
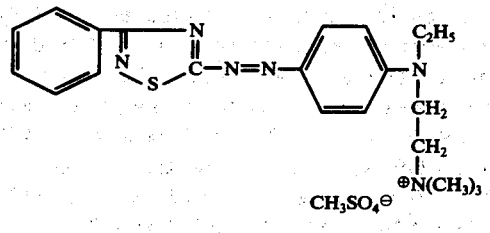
(G)
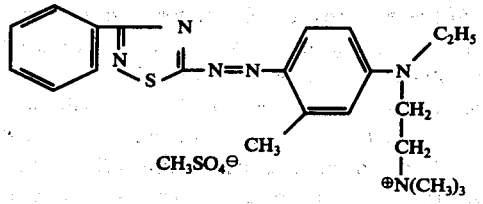
(H)
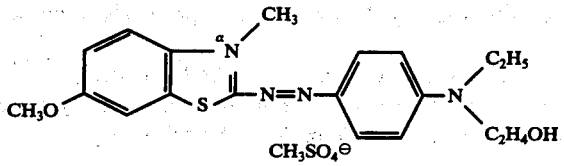
(J)
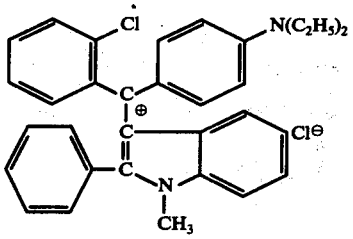
(K)
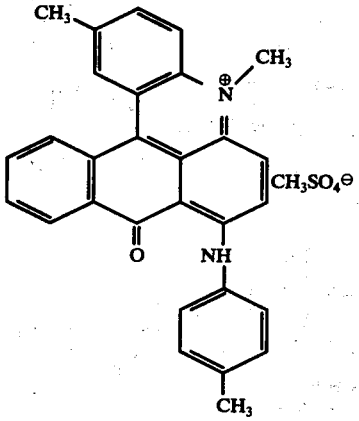
-continued
(L)
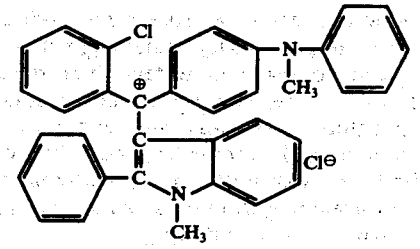
(M)
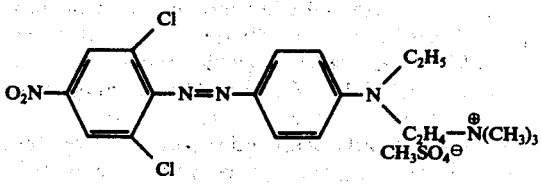
(N)
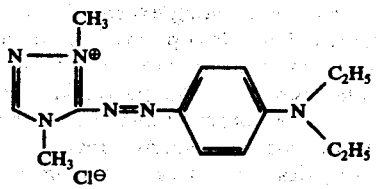
(O)
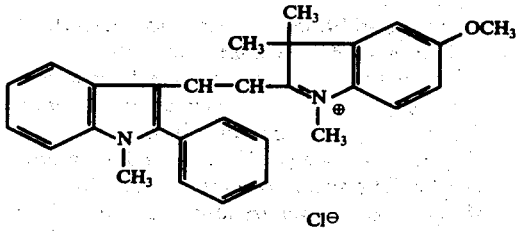
1 : 2 chromium complex of
(P)
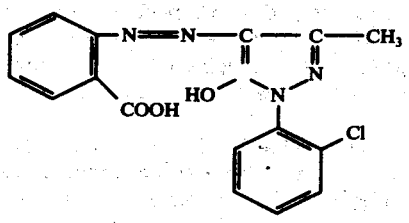
cobalt complex of
(Q)
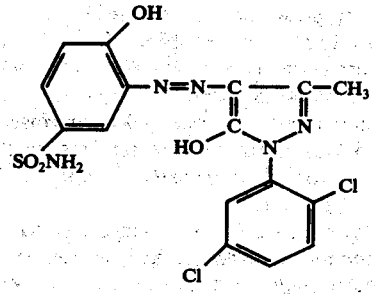
chromium complex of -continued (R)

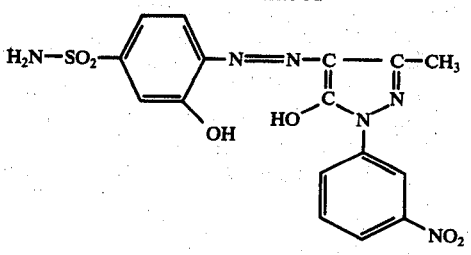

1 : 2 chromium complex of (S)

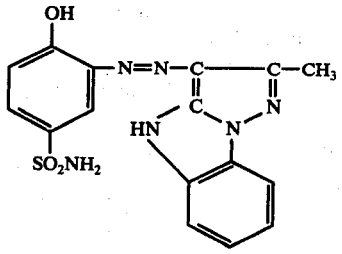

(T)

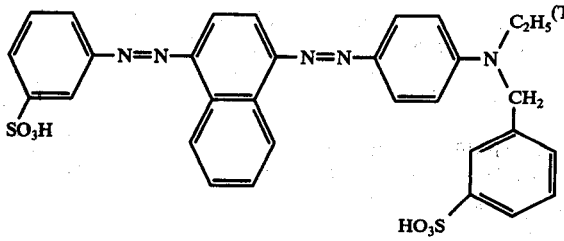

(U)

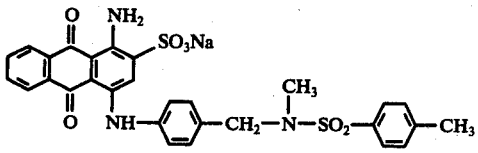

(V)

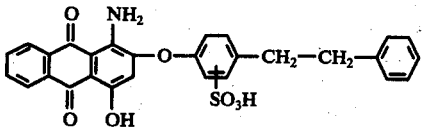

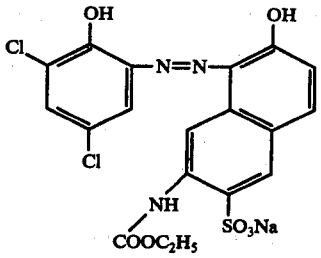

Dyeing of the filaments in the aqueous dye bath is preferably carried out before stretching, although it can also be carried out during stretching of the filaments.

The concentration of dye in the dye bath amounts to between 0.01 and 5% and preferably to between 0.2 and 1%. The temperature of the dye bath may be in the range from 20° to 100° C, although it is preferably kept at 50° to 80° C.

In one preferred embodiment, from 1 to 40% by weight and preferably from 10 to 25% by weight (based on the total weight of the bath) of a polar organic solvent, for example dimethyl acetamide, N-methyl pyrrolidone, dimethyl formamide or hexamethyl phosphoric acid tris amide, is added to the aqueous dye bath. It is preferred to use the same solvent as is used for preparing the spinning solution.

More particularly, the process is carried out as follows:

The polycondensation and the preparation of suitable spinning solutions of the polyamides are adequately described in the abovementioned patent specifications.

Spinning is carried out by the dry-spinning process known per se in which individual spinning conditions may be varied within wide limits. It is advantageous to use spinning solutions with viscosities in the range from 1000 to 2500 poises at 20° C and with a solid polyamide concentration, corresponding to those viscosities, of from about 17% to 30% by weight. The spinnerets used are 48 – 288-bore-spinnerets with a bore diameter of from 0.2 to 0.3 mm. The spinning duct temperature is between 160° C and 220° C. The take-off rate is with advantage from 70 to 250 meters per minute.

The dry-spun filaments are introduced before stretching into an aqueous dye bath containing from 0.01 to 5% by weight and preferably from 0.2 to 1% by weight (based on the bath) of a cationic or anionic dye in dissolved form. The bath is kept at a temperature of from 20° to 100° C and preferably at a temperature of from 50° to 80° C. The average residence time of the filaments is 10 to 30 seconds. In one preferred embodiment of this process, the dye bath additionally contains from 1 to 40% by weight and preferably from 10 to 30% by weight (based on the total weight of the bath) of a polar organic solvent such as N-methyl pyrrolidone, dimethyl acetamide, dimethyl formamide or hexamethyl phosphoric acid tris-amide.

The filaments are then passed through an aqueous washing bath with a temperature in the range from 20° to 80° C. The residence times in the washing bath are preferably from 10 to 60 seconds, although residence times of up to 5 minutes are also possible. After it has passed through the washing bath, the filament has a solvent content of less than 3%.

The aftertreatment of the precipitated and washed filaments is governed by the chemical structure of the filaments and is described in the Patent Specifications quoted above. In general, it is best to subject the filaments to a two-stage stretching process, in which they are initially stretched in boiling water in a ratio of 1:1.2 to 2.2, followed by stretching on a curved heating surface or on a godet at a temperature in the range from 200° to 360° C, the stretching ratio in this second stage of the stretching process being from 1:2.0 to 8.0. Preliminary stretching may even be carried out during dyeing in the dye bath. The filaments thus obtained show the favorable textile properties which are specific to them and which are described in the patent literature. In addition, they are given deep, washproof dye finishes by a simple, continuous process. Comparison of this gel-phase dyeing process with the conventional "high-temperature dyeing" process surprisingly shows that dyeing in the gel phase produces a deeper dye finish. The depth of color of the dyed filaments was determined by remission measurement in accordance with DIN 5033 in the standard color values X, Y and Z.

The following Examples are to further illustrate the invention without limiting it:

EXAMPLE 1

A 16.8% solution of the aromatic polyamide

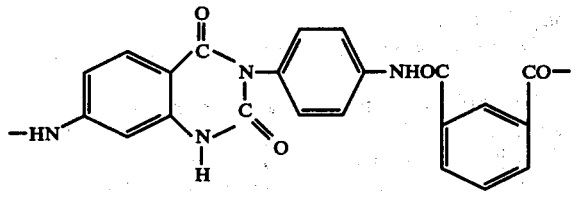

in dimethyl acetamide (solution viscosity 2400 Poises at 20° C, $\eta_{rel.} = 2.0$, as measured on a 0.5% solution in N-methyl pyrrolidone at 20° C) was dry-spun through a 72-bore spinneret (bore diameter 0.2 mm). The spinning duct temperature was 190° . The take-off rate was 130 meters per minute.

The tow thus obtained was drawn at 5 meters per minute through a dye bath containing a red dye of constitution (N) in a concentration of 10 g/l at a temperature of 60° C. The residence time in the dye bath was 14 seconds. The dyed filaments were then washed in boiling water and at the same time prestretched in a ratio of 1:1.5. Final stretching was carried out after drying on a heating godet at a temperature of 285° C (stretching ratio 1:1.2). The following textile properties were measured:

Tensile strength: 4.0–4.2 g/dtex
Elongation: 5%

The filaments had a wash-proof red dye finish.

EXAMPLE 2

The spinning solution described in Example 1 was spun, dyed and aftertreated in the manner described in that Example. The dye used on this occasion was a mixture of the red dyes

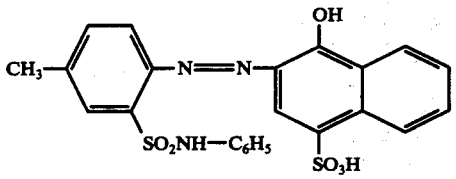

and

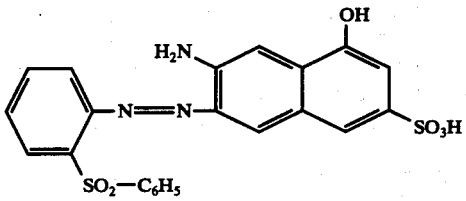

The dye finish was deep and washproof. Coloristic fasteness to light: 3–4.

EXAMPLE 3

The spinning solution, described in Example 1, of the aromatic polyamide containing quinazolindione structures was spun in the manner described in Example 1, dyed in a dye bath containing 10 g/l of the yellow dye (P) and stretched in two stages. The dye finish was very deep and washproof. Coloristic fastness to light: 5–6

EXAMPLE 4

Filaments were produced by the conventional dry-spinning process from an 18.7% by weight solution of poly-(m-phenyleneisophthalamide) in dimethyl acetamide which additionally contained approximately 2% of calcium chloride as solution promotor (solution viscosity $\eta = 1750$ Poises, $\eta_{rel.} = 1.95$). The duct temperature was 180° C. The filaments were run off from the spinneret at 110 meters per minute and wound into package form with a slight residual solvent content.

The tow thus produced was passed at 5 meters per minute through an aqueous dye bath containing 20% by weight of dimethyl acetamide and 10 g/l of the dye (N). After a residence time in the dye bath of approximately 14 seconds, the filaments were washed in boiling water and prestretched in a ratio of 1:1.5. The filaments were then fixed under tension in steam at 130° C (residence time 140 seconds). In order to increase its tensile stretch, the filament yarn was finally stretched in a ratio of 1:2 on a curved heating surface with a temperature of 120° C.

Tensile strength: 3.2–3.5 g/dtex
Elongation: 25%

The filaments had a washproof deep red dye finish. Coloristic fastness to light: 5.

The filaments dyed in the gel bath were found by remission measurement in accordance with DIN 5033 to have the following standard color values X, Y and Z:

22.7 — 13.8 — 13.5

Filaments which, for comparison, had been subjected to high-temperature dyeing, did not have such a deep dye finish, as can be seen from the higher standard color values X, Y and Z:

30.0 — 17.7 — 21.9

EXAMPLE 5

The spinning solution described in Example 4 was spun in the same way as described in that Example and dyed in a dye bath which, in addition to approximately 20% by weight of dimethyl acetamide, contained 10 g/l of dye (A). The bath temperature was 98° C. The filaments were prestretched in a ratio of 1:1.5 during dyeing in the dye bath. Final stretching in a ratio of 1:1.3 was carried out after drying on a curved heating surface with a temperature of 290° C.

Tensile strength: 3.0–3.2 g/dtex
Elongation: 20–30%

The dye finish was deep blue and washproof. Coloristic fastness to light: 3–4.

EXAMPLE 6 4. 6

The spinning solution described in Example 4 of poly(m-phenylene-isophthalamide) in dimethyl acetamide was spun, dyed and aftertreated in the same way as in Example 4. The dye used on this occasion was dye (P). A deep washproof dye finish with a coloristic fastness to light of 6 was obtained.

EXAMPLE 7

A spinning solution, prepared by condensing tolylene-2,4-diamine and terephthalic acid dichloride in dimethyl acetamide, which contained 3% of calcium chloride as solution promotor had a solution viscosity of 1450 Poises ($\eta_{rel.} = 2.1$, as measured on a 0.5% solution of the polyamide in N-methyl pyrrolidone at 20° C). The solution had a solids content of 14%. The solution was dry-spun through a 72-bore spinneret with a bore diameter of 0.2 mm. A temperature of 180° C was maintained in the spinning duct. The take-off rate amounted to 125 meters per minute.

This dry-spun material was drawn through a dye bath containing 10 g/l of dye (A). The dye bath additionally contained 20% by weight of dimethyl acetamide. The bath temperature was 60° C. After a residence time of the filaments in the dye bath of 14 seconds, the filaments entered a boiling water bath in which they were washed and at the same time stretched in a ratio of 1:1.4. Final stretching in a ratio of 1:1.2 was carried out after drying on a curved heating surface with a temperature of 300° C.

Tensile strength: 3.5 g/dtex
Elongation: 4%

The dye finish was deep and washproof.

EXAMPLE 8

A solution of an aromatic copolyamide containing quinazolindione structures in DMA ($\eta_{rel.} = 1.83$), which had been prepared by polycondensing 305 parts by weight of m-phenylene diamine, 151 parts by weight of 3-(p-aminophenyl)-7-amino-2,4-(1H,3H)-quinazolindione and 761 parts by weight of isophthalic acid dichloride, was dry-spun through a 120-bore spinneret. The filaments were run off at a rate of 120 meters per minute. The duct temperature was 200° C. This dry-spun material which had a slight residual solvent content was passed through a dye bath containing 10 g/l of the dye (P), bath temperature 80° C. The residence time in the dye bath was 14 seconds. The dyed filaments were stretched in a ratio of 1:1.5 in boiling water, dried and finally stretched in a ratio of 1:1.3 on a curved heating surface with a temperature of 300° C.

Tensile strength: 2.9–3.3 g/dtex.
Elongation: 8%

The dye finish of the filaments was deep and washproof. Coloristic fastness to light: 5–6.

What we claim is:

1. A process for the production of dyed filaments of aromatic polyamides which comprises continuously dyeing dry-spun gel filaments of an aromatic polyamide which has not been modified with acid or basic groups before or during stretching, in an aqueous dyebath containing a water-soluble, cationic dye in dissolved form.

2. The process of claim 1, wherein said filaments are first dyed and subsequently stretched.

3. The process of claim 1, wherein said filaments are prestretched during dyeing in said aqueous dye bath.

4. The process of claim 1, wherein said aqueous dye bath contains from 0.01 to 5% by weight of dissolved dye.

5. The process of claim 1, wherein said aqueous dye bath contains from 0.2 to 1% by weight of dissolved dye.

6. The process of claim 1, wherein said aqueous dye bath has a temperature of from 20° to 100° C.

7. The process of claim 1, wherein said aqueous dye bath additionally contains from 1 to 4 % by weight (based on the total weight of the bath) of a polar organic solvent.

8. The process of claim 7, wherein said polar organic solvent is a member selected from the group consisting of dimethyl acetamide, N-methyl pyrrolidone, dimethyl formamide of hexamethyl phosphoric acid tris-amide.

9. The process of claim 1, wherein said polyamide is a poly-m-phenylene isophthalamide.

10. The process of claim 1, wherein said polyamide is a heterocyclic polyamide corresponding to the formula

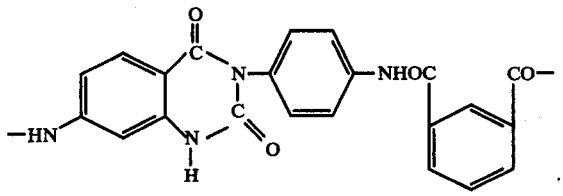

11. The process of claim 1 wherein the aromatic polyamide further contains heterocyclic groups.

* * * * *